US005839982A

United States Patent [19]

Hying et al.

[11] Patent Number: 5,839,982

[45] Date of Patent: Nov. 24, 1998

[54] STEEL FRAMED BASKETBALL BACKBOARD WITH PLASTIC RETAINER AND METHOD OF MAKING SAME

[75] Inventors: Clement F. Hying, Menomomee Falls; Randy R. Schickert, Kewaskum; Ronald A. White, N. Prairie, all of Wis.

[73] Assignee: Huffy Corporation, Miamisburg, Ohio

[21] Appl. No.: 742,873

[22] Filed: Nov. 1, 1996

Related U.S. Application Data

[63] Continuation-in-part of Ser. No. 593,321, Jan. 31, 1996, abandoned.

[51] Int. Cl.[6] ..... A63B 63/08

[52] U.S. Cl. ..... 473/481

[58] Field of Search ..... 473/474, 481, 473/482

[56] References Cited

U.S. PATENT DOCUMENTS

| | | | |
|---|---|---|---|
| 3,462,143 | 8/1969 | Bidelman et al. | 473/481 |
| 4,320,896 | 3/1982 | Engle et al. . | |
| 4,372,555 | 2/1983 | Sorensen | 473/481 |
| 4,424,968 | 1/1984 | Smith . | |
| 4,478,415 | 10/1984 | Shaffer et al. . | |
| 4,588,188 | 5/1986 | Mahoney et al. | 473/481 |
| 4,650,188 | 3/1987 | Schroeder | 473/481 |
| 4,739,988 | 4/1988 | Schroeder | 473/481 |
| 4,895,365 | 1/1990 | Schroeder . | |
| 5,114,141 | 5/1992 | Mahoney . | |
| 5,120,054 | 6/1992 | Wetzel . | |
| 5,207,419 | 5/1993 | Schroeder | 473/481 |

FOREIGN PATENT DOCUMENTS

| | | |
|---|---|---|
| 57-150971 | 9/1982 | Japan . |

*Primary Examiner*—Raleigh W. Chiu
*Attorney, Agent, or Firm*—Michael J. Bell; Howrey & Simon

[57] ABSTRACT

A basketball backboard assembly for supporting a rebound member having a tubular steel frame and one or more plastic channels connecting the rebound member to the frame in a manner that protects the edge of the rebound member. The steel frame includes an outer section preferably formed from a single piece of tubular steel and an inner section welded to the outer section. The plastic channel includes a first slot which receives the peripheral edge of the rebound member and a second slot which receives a portion of the outer section of the frame.

43 Claims, 14 Drawing Sheets

STEEL FRAMED BASKETBALL BACKBOARD WITH PLASTIC RETAINER AND METHOD OF MAKING SAME

RELATED APPLICATION

This application is a continuation-in-part of copending application Ser. No. 08/593,321, filed Jan. 31, 1996 now abandoned.

BACKGROUND OF THE INVENTION

1. Field of the Invention

The invention relates generally to basketball backboards and, in particular, to a basketball backboard having an extruded plastic member supporting a rebound member on a frame to which a basketball goal and backboard support system may be attached.

2. Description of Related Art

Basketball backboards are currently made from a variety of materials. Typically, basketball backboards have been provided with a steel or aluminum extruded frame formed from individual sections that are joined to form a support for a backboard rebound member. The frame not only supports the rebound member, but includes holes or the like to facilitate mounting the backboard to a support structure, such as an extension arm or elevator, and a support post. The rebound member has been formed from a plastic material, commonly acrylic. A disadvantage associated with many basketball backboards is that the peripheral edge of the rebound member may be exposed, thereby increasing the risk of cracking when the edge is struck by a basketball or other object.

In one known prior backboard developed by the assignee of this application, the backboard frame comprises four substantially straight extruded aluminum members each having an "F"-shaped cross section defining a pair of parallel flanges and four diecast corner members. The frame members are aligned to wrap around the edge of the backboard with the flanges extending along opposing sides of the backboard and the extruded members connected to the corner members by a fastener. In forming the extruded frame member, the spacing of the flanges must be sufficient to accommodate any tolerance variations in the thickness of the backboard rebound surface. Thus, it is possible for gaps or a loose fit to occur between the existing frame structure and the backboard surface resulting in variations in the amount of rigidity and/or support provided by the frame. The backboard is mounted to a support structure through openings in two of the frame members. The frame members have an open slot extending along the length of each member. At a predetermined position along the slot, an enlarged portion is formed for receiving the head of a mounting bolt associated with the support structure. The head of the bolt is retained within the cross section of the frame, but is slidable along substantially the full length of the support structure during assembly.

Further, the assembly of the above-described backboard structure requires that the frame and backboard surface be moved toward each other in a sideways direction such that the frame is essentially wrapped around the backboard surface during assembly. Thus, assembly of the prior backboard requires that the edge of the backboard surface be aligned with a slot defined between the parallel flanges as the backboard is brought into association with the frame.

Although this multi-piece frame structure has worked well from the standpoint of providing a rigid support for rebounding a basketball, it has certain disadvantages, especially from the standpoint of ease of manufacturing and assembly. In particular, alignment of the eight frame pieces with the rebound member prior to interconnection is a labor-intensive process. Moreover, the use of aluminum to form the frame members is costly. Finally, allowing the backboard support mounting bolts used to slide the entire length of the frame member may make attachment to a support structure difficult.

FIG. 1 schematically illustrates another known basketball backboard construction, which includes a welded steel frame 1 having diagonal supports 2 and a substantially planar acrylic sheet 3. As shown in the simplified side view of FIG. 2, which obviously is not to scale, a rectangular acrylic sheet 3 is attached to frame 1 by a double-sided adhesive layer 5. The sheet 3 has an outer perimeter edge 3*a*, which is completely exposed at all four sides of the sheet. A basketball goal may be mounted to frame 1 by way of holes 4 located through diagonal supports 2. The basketball backboard is attached to a support structure by way of mounting apertures 6 located on diagonal supports 2. The mounting apertures are threaded inserts, which receive a bolt or similar fastener from the support structure.

This type of frame construction suffers from more drawbacks and disadvantages than the aluminum extruded backboard described above. Most notably, is the use of adhesive material, which may not be strong enough to retain the acrylic sheet against the frame for an extended period. Thus, the rebound member may not be sufficiently supported by the backboard frame, thereby decreasing rebounding performance. Additionally, the entire edge of the acrylic sheet is exposed and, therefore, highly susceptible to cracking when the edge is struck by a ball or other object. Once a crack exists, it may propagate throughout the acrylic sheet and compromise the integrity of the backboard assembly. In addition, broken pieces of acrylic can fall from the supporting frame thereby exposing a player to injury. Another disadvantage is the bolt mounting structure. The threaded insert design does not accommodate for variations in the thickness of the particular mounting and support structure employed. Therefore it requires the precise size bolt to successfully attach the backboard to its support. Also, prior to the invention described herein backboards utilizing steel frames have been costly to manufacture and possess excessive weight, thereby increasing the requirements for the backboard support assembly, shipping costs, etc.

In the backboard assembly disclosed in the parent application, a molded plastic frame supports a rebound member having a rebound surface. The frame includes a front and a rear section, which is made by injection molding or with gas assist in combination with a strength-enhancing technique like structurally foaming or fiberglass-reinforcing the plastic. The rebound member is supported between the front and rear frame sections which completely encapsulate the peripheral edge of the rebound member.

Even though molded plastic frame backboards made according to the parent application work well and have achieved commercial success, there is a need for a backboard that performs comparably from the standpoint of rebound characteristics and durability, yet costs less and is easy to manufacture and assemble, while at the same time avoiding the problems of the prior art backboard designs.

SUMMARY OF THE INVENTION

The invention meets these needs and avoids the disadvantages and drawbacks of the above-described prior art by providing a basketball backboard assembly having a tubular steel frame for supporting a rebound member having a rebound surface. One or more preferably extruded plastic retainers connected to the frame supports rebound member on the frame in a manner that encapsulates its peripheral edge substantially or completely.

The tubular frame of the invention may be formed separately and is defined by an outer and inner frame sections preferably welded together. The outer section may be formed from a single piece of tubular steel bent and welded together to form a desired backboard support shape, such as the generally rectangular shapes with rounded corners illustrated herein. The inner section preferably is also made from tubular steel welded to the outer section to enhance the strength and rigidity of the outer section. The frame includes apertures or similar structure for mounting the backboard assembly to conventional support systems known in the art. The mounting apertures do not extend through the entire cross-section of the frame thereby preventing mounting fasteners positioned in the apertures from coming into contact with the rebound member. The frame also includes additional apertures or similar structure for mounting a basketball goal thereto.

The rebound member of the invention has a peripheral edge and a substantially planar rebound surface as is conventional in the art. The rebound member is preferably formed from a molded plastic material, typically a polycarbonate or acrylic. However, the invention also enables other types of materials to be used for the rebound member, including wood, fiberglass, laminate, tempered glass and metal, although the maximum benefits of the invention may not be achieved with such materials.

The plastic retainer of the invention may be formed as one or several pieces of plastic from any known thermoplastic, such as polyvinylchloride (PVC), which preferably is extruded into the shape of a channel having a generally E-shaped cross-section forming first and second slots. The first slot receives the tubular frame and the second slot receives the peripheral edge of the rebound member, each preferably with an interference fit. The plastic retainer may be formed of several pieces disposed around the perimeter of the tubular frame, or as a single piece connected to the entire perimeter to encapsulate substantially all of the entire peripheral edge of the rebound member, respectively. In either case, the plastic retainer reduces the amount of exposed surfaces at the edge of the rebound member to reduce susceptibility to cracking. By providing support at the peripheral edge of the rebound member, the plastic retainer provides substantially unobstructed access to the rebound surface of the rebound member. The plastic retainer may be detachably connected to the frame by an interference fit in the second slot and/or by suitable fasteners.

The invention thus enables the backboard assembly to be relatively lightweight, durable and less costly than either molded plastic frames or extruded aluminum frames, while maintaining or surpassing the performance of prior art backboards. By encapsulating at least a significant portion of the rebound member within the plastic retainer, cracking and damage to the rebound member is significantly reduced or eliminated. Moreover, even if cracking does occur, the broken pieces should be trapped within the assembly due to this encapsulation feature. The plastic retainer provides a small clearance space between the rebound member and the frame which allows the rebound member to flex controllably across its surface when an object such as a basketball is thrown against the backboard assembly, thereby permitting the assembly to withstand greater impact forces.

These and other advantages of the invention will be apparent from consideration of the detailed description of the invention and accompanying drawings described below.

DESCRIPTION OF THE DRAWINGS

FIGS. 12*a–b* are partial front views illustrating a notched corner section of a first alternative embodiment of the plastic channel member of the invention.

FIGS. 12*c–d* are partial front views illustrating a notched corner section of a second alternative embodiment of the plastic channel member.

FIGS. 12*e–f* are partial views illustrating a notched corner section of a third alternative embodiment of the plastic channel member.

DETAILED DESCRIPTION

Figure 1:
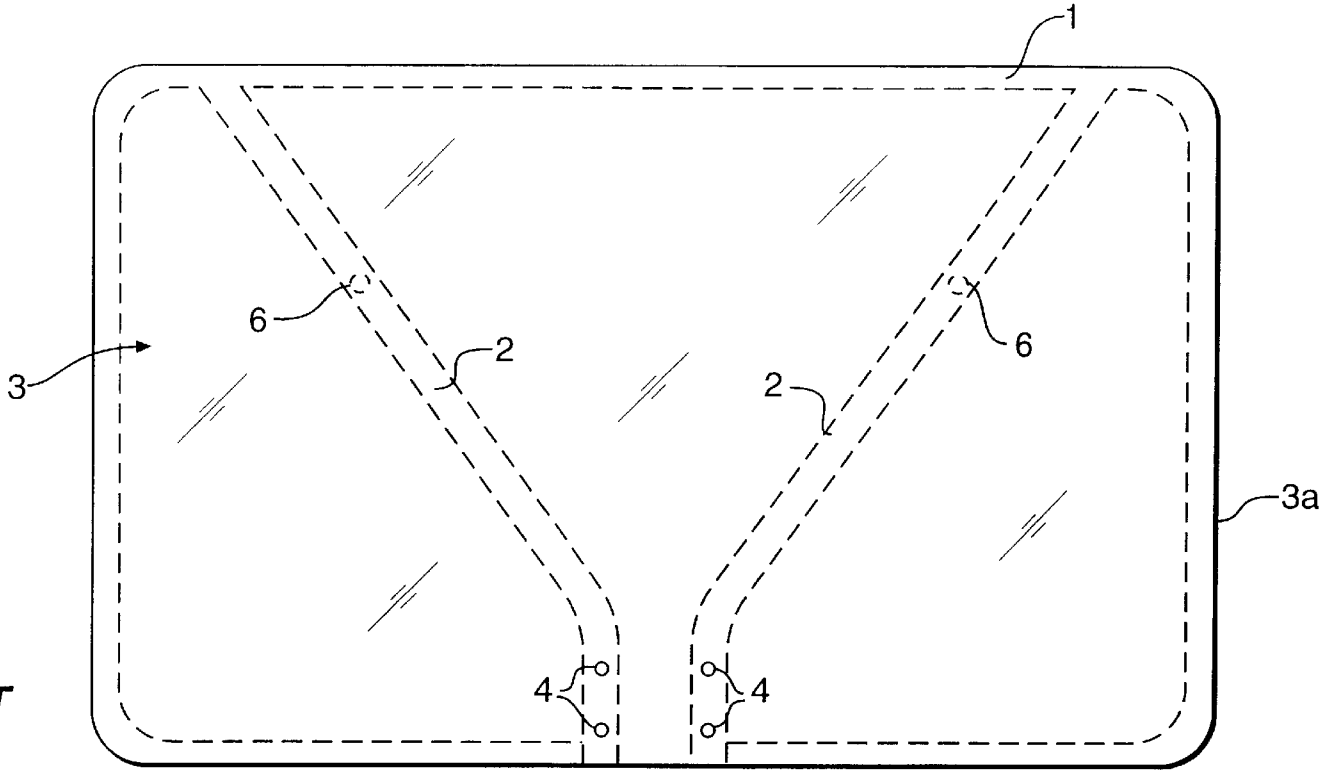
FIG. 1 PRIOR ART
FIG. 1 is a plan view schematically illustrating a prior art backboard.
Figure 2:
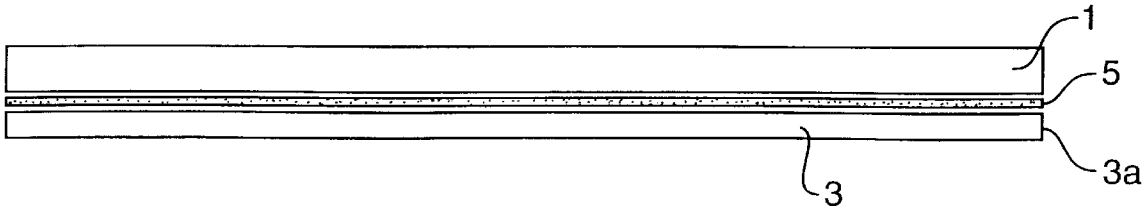
FIG. 2 PRIOR ART
FIG. 2 is an enlarged simplified, elevational view illustrating a side of the prior art backboard shown in FIG. 1.
Figure 3:
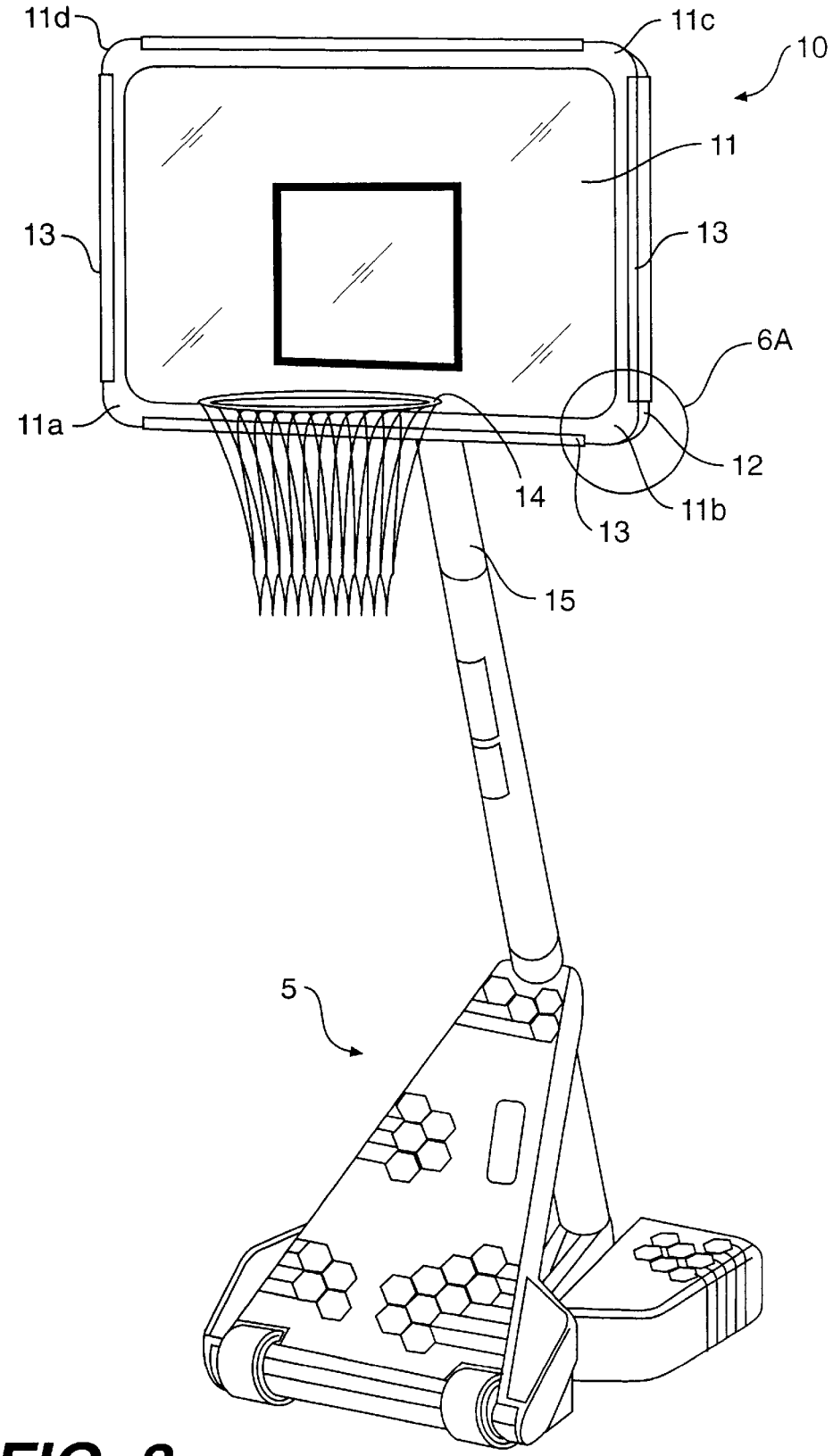
FIG. 3 is a perspective view illustrating a backboard assembly constructed according to the principles of the invention in which a rebound member is supported on a steel frame by a series of plastic channel members.

Referring first to FIG. 3, the principles of the invention are illustrated in this simplified view of a backboard assembly 10, which generally includes a rebound member 11 supported on a frame 12 by a plurality of plastic channel members 13 connected to the outer perimeter of the frame. As will be more apparent from the drawings and detailed description below, the plastic channel members 13 encapsulate substantially all of the peripheral edge of the rebound member 11, leaving only the four small curved corner portions 11*a–d* exposed. Although the frame and rebound member are shown as having a generally rectangular shape, other shapes known in the art such as fan-shapes may be employed. A basketball goal 14 usually in the form of a metal rim and hanging net may be mounted to the backboard assembly 10 in a conventional manner. The goal may be formed as a breakaway goal that pivots downwardly in response to application of a predetermined force. An example of a particularly advantageous breakaway goal that may be mounted to the backboard assembly of the invention is described in the assignee's allowed, copending patent application Ser. No. 08/282,521, the disclosure of which is incorporated by reference herein. The net may be detachably mounted to the rim by use of a breakaway net attachment system, such as that described in the assignee's U.S. Pat. No. 5,524,883, the disclosure of which also is incorporated by reference herein. The backboard assembly 10 may be mounted upon conventional support structures known in the art. FIG. 3 illustrates the backboard assembly mounted upon the pole 15 of a portable support system 5 constructed according to the assignee's U.S. Pat. No. 5,415,393, although the backboard assembly of the invention may be use with other known portable support systems as well.

Figure 4:
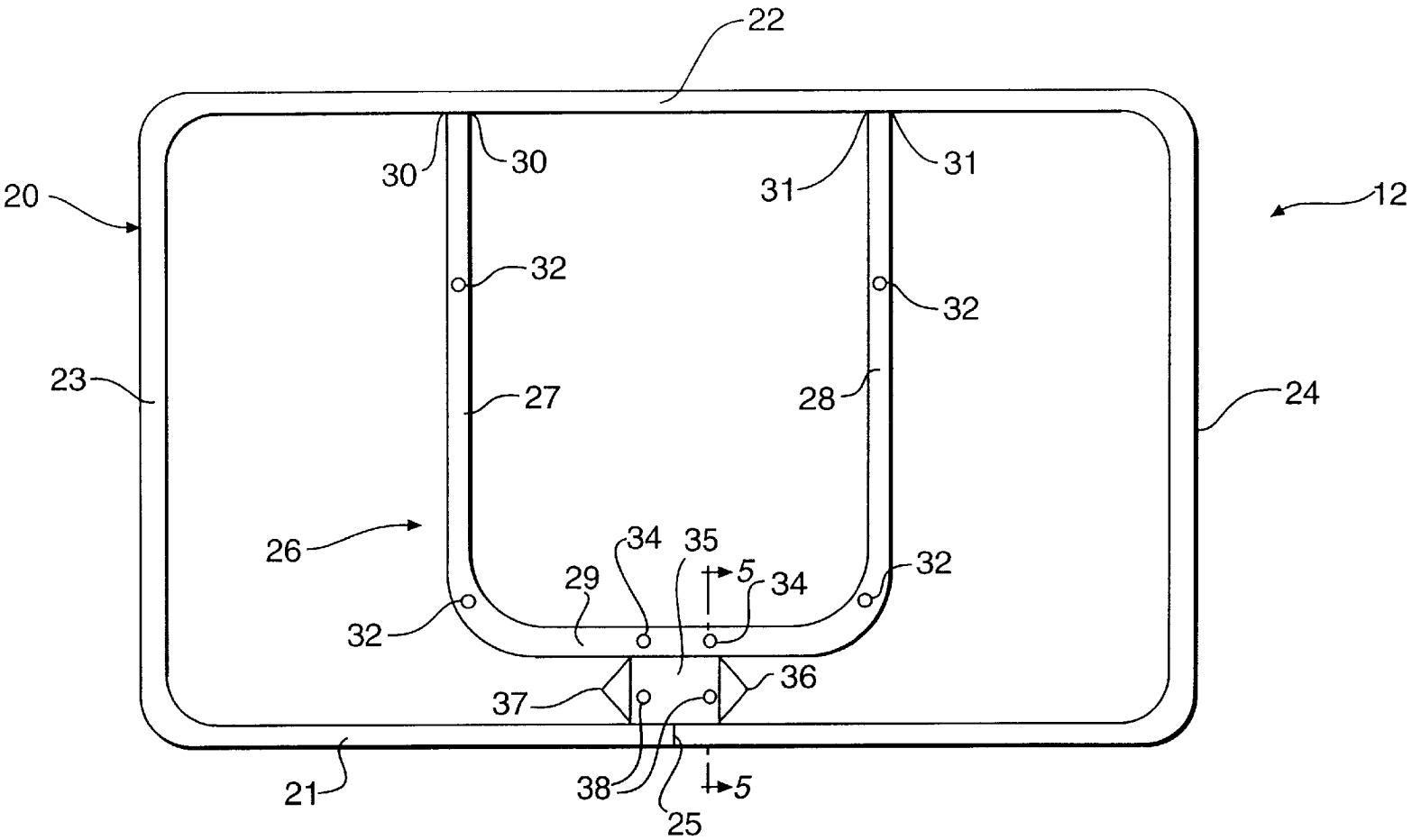
FIG. 4 is a rear plan view of the frame shown in FIG. 3.

Turning now to FIG. 4, a preferred embodiment of the frame 12 for supporting the rebound member is shown and includes outer and an inner sections of tubular steel. The outer frame section 20 is formed into a generally rectangular shape defined by horizontal portions 21 and 22 and vertical portions 23 and 24 by bending a predetermined length of tubular steel stock in any conventional steel bending apparatus. After the piece of tubular steel is bent to the desired shape, its ends are preferably positioned approximately in the middle of horizontal portion 21 at a small gap from each other, as shown schematically at 25. Gap 25 allows for greater tolerances in the length of the outer section 20 during manufacturing. The cross section of the outer frame section 20 may be substantially square with dimensions of approximately 1"×1" and a wall thickness of approximately 0.049 inches being preferred, but other dimensions and thicknesses may be used as the skilled artisan will appreciate. The outer frame section 20 thus defines the outer perimeter of the backboard assembly 10. This frame embodiment is particularly suited for a backboard having a width of approximately 44 inches although other sizes may be employed as well.

The inner section 26 of frame 12 is formed from a generally U-shaped beam. Similar to the outer frame section 20, the beam preferably is also made from conventional stock of 1" square tubular steel, but a thickness of 0.065 inches is preferred. Again other dimensions and thicknesses may be used. Inner frame section 26 is formed into a generally U-shaped configuration defined by vertical portions 27 and 28 and horizontal portion 29 by conventional steel bending apparatus.

Figure 5:
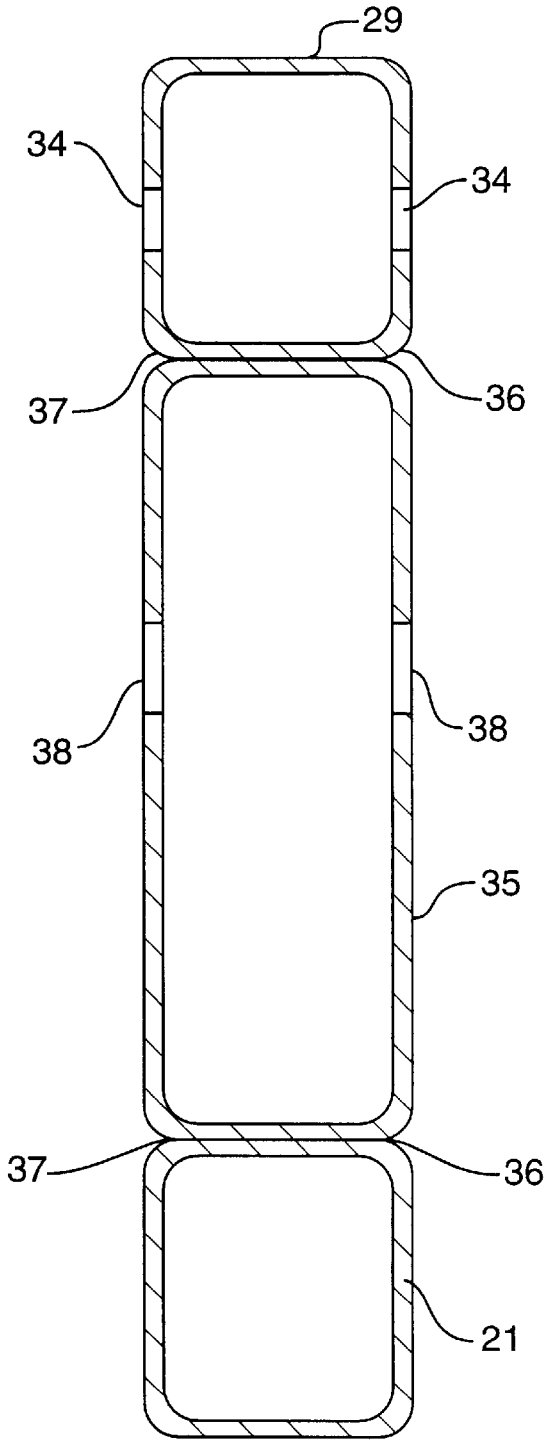
FIG. 5 is a cross sectional view taken along lines 5—5 of FIG. 4 illustrating the tubular construction of the frame and support plate.

The horizontal portion 29 of the inner frame section 26 is connected to a support plate 35, preferably by upper welds shown schematically at 36, 37. As shown best in FIG. 5, the support plate 35 may also be formed from tubular steel stock that is connected to the lower horizontal portion 21 of outer frame section 20, near gap 25 preferably by lower welds shown schematically at 36, 37. Thus, the support plate 35 connects the outer and inner frame section 20 and 26 together to provide a substantially rigid, unitary frame capable of supporting a rebound member. In the 44" backboard frame embodiment, the plate 22 is approximately 1" wide by 3" in height, and has the same thickness as the outer frame sections, however, it is understood other suitable dimensions may be used. In addition, these dimensions would probably change depending upon the size of the frame, the length of the vertical beam portions 27 and 28 employed, etc.

Figure 8:
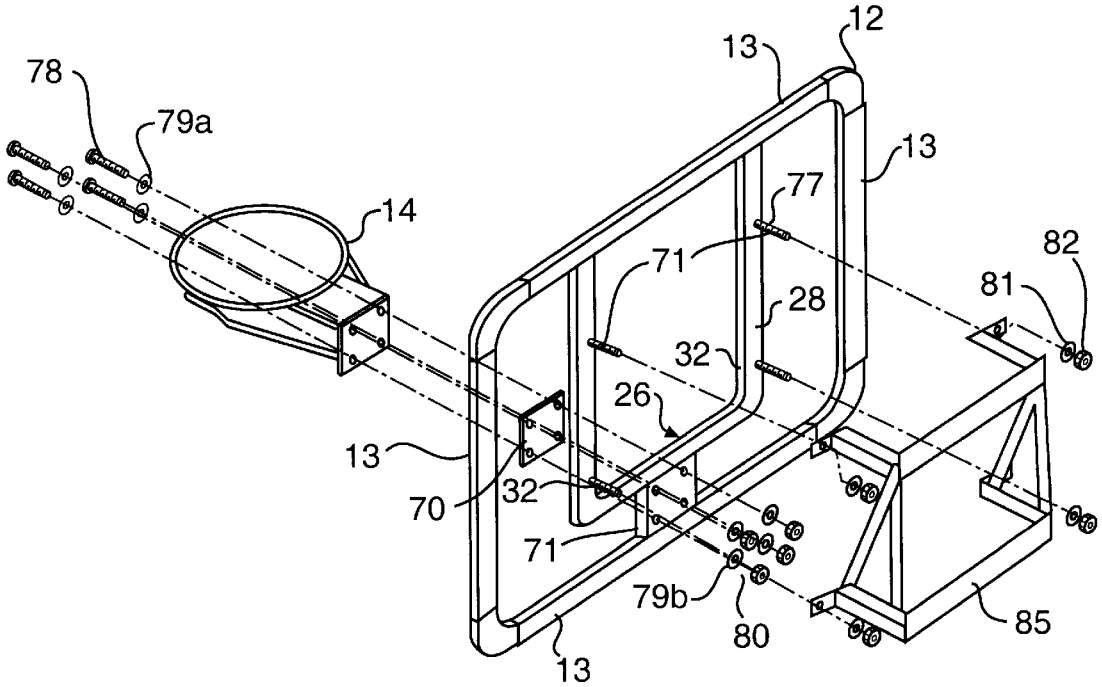
FIG. 8 is a rear perspective view schematically illustrating how the backboard assembly of the invention may be assembled with a basketball goal and mounted to a pole, roof, or wall support structure.
Figure 9:
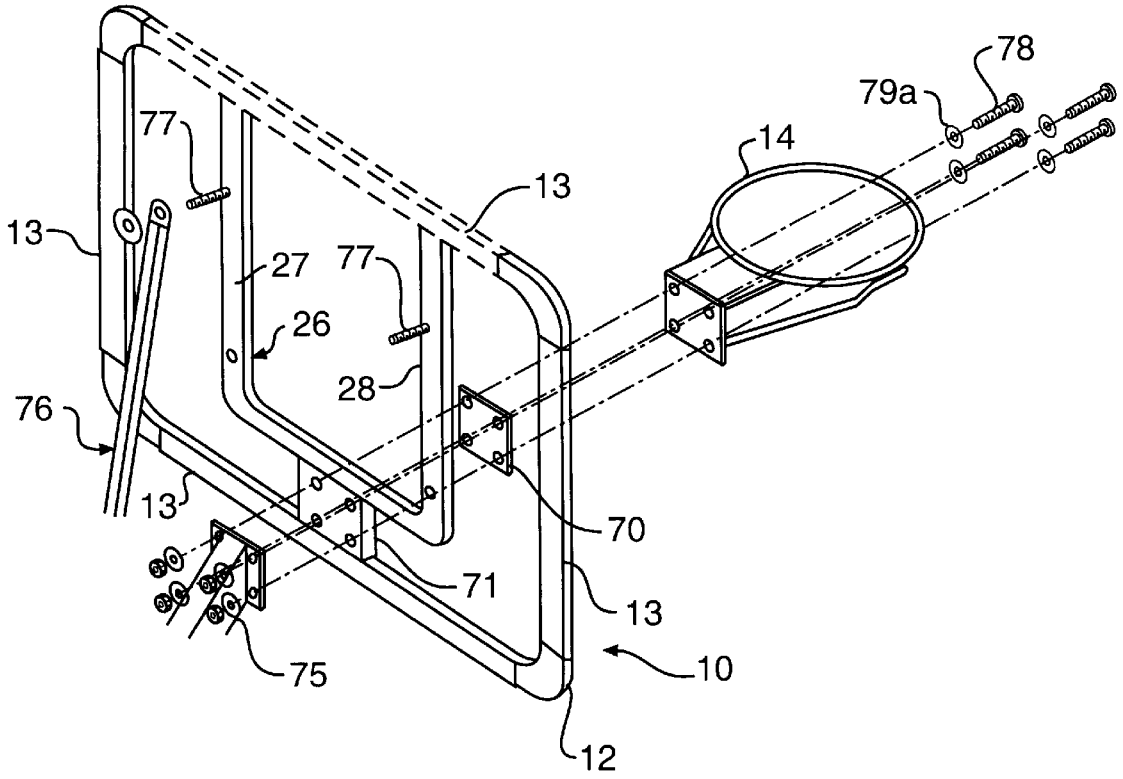
FIG. 9 is a rear perspective view schematically illustrating how the backboard assembly of the invention may be assembled with a basketball goal and mounted to a support arm and extension arms of a support structure.
Figure 10:
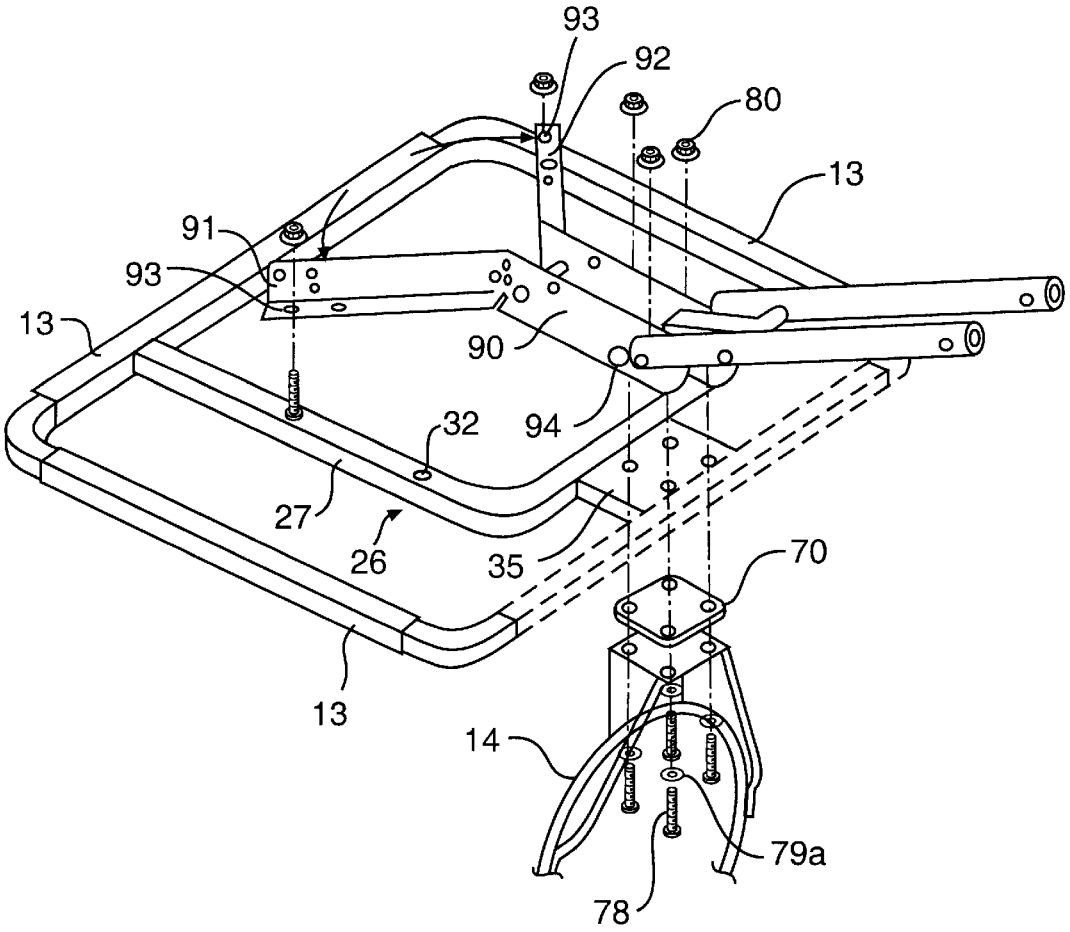
FIG. 10 is a rear perspective view schematically illustrating how the backboard assembly of the invention may be assembled with a basketball goal and mounted to an elevator mechanism of a support structure.
Figure 10A:
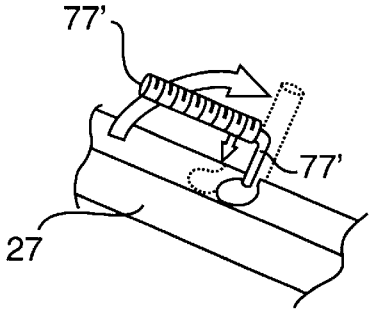
FIG. 10A is an exploded view of the insertion of an angled bolt into a vertical beam of the backboard assembly shown in FIG. 10.

The inner frame section 26 and support plate 35 may also be provided with suitable apertures or other structure to facilitate mounting of a basketball goal and backboard support system, such as a pole, elevator arm, wall mounting bracket, etc., as is known in the art. Examples of such mounting structures are shown in FIGS. 8–10 described subsequently. The vertical portions 27 and 28 include apertures 32 for receiving suitable fasteners for attaching the backboard assembly to a support structure. Each aperture 32 only extends through one of the walls of its vertical portion 27 or 28 to prevent the fasteners from extending through or coming into contact with the rebound member 11, as is described in more detail below. Horizontal portion 29 includes goal mounting apertures 34 for receiving bolts or similar fasteners used to mount a basketball goal to the frame 12 in a conventional manner. The support plate 35 also includes two apertures 38 used to mount a basketball goal to the frame. Unlike apertures 32, apertures 34 and 38 extend completely through the inner frame section 26 and support plate 35 (see FIG. 5) and cooperate with similar apertures formed in the rebound member to mount the goal.

Figure 6:
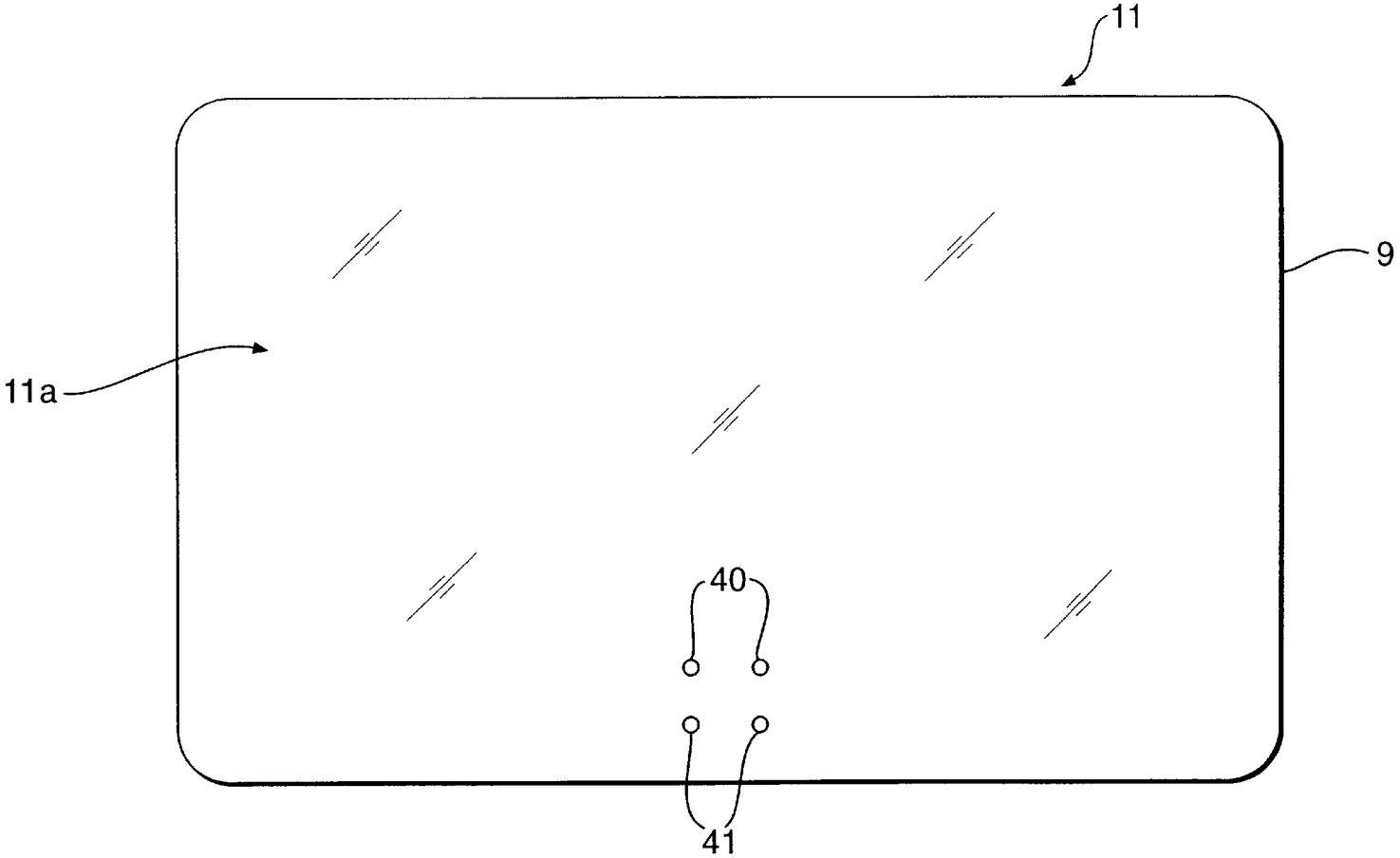
FIG. 6 is a front plan view of the rebound member shown in FIG. 3.

The rebound member 11 is a substantially planar sheet or substrate, generally of rectangular shape with rounded corners as illustrated in FIG. 6 which generally matches the contour and perimeter of frame 12. Rebound member 11 is preferably formed from a molded plastic, such as acrylic or polycarbonate. Acrylic is the preferred type of thermoplastic used in the invention and it may be clear or tinted; however, other planar substrates such as laminate, wood, aluminum or other extruded material, metal, and tempered glass also may be used. The front face 11*a* of the rebound member defines a rebound surface having sufficient rigidity when assembled with the extruded plastic member 13 and the frame 12 to rebound a basketball tossed against the backboard assembly 10. The front face 11*a* may also have graphics and other ornamental features thereon as illustrated with reference to FIG. 3. The thickness of rebound member 11 may vary depending upon the particular rebounding characteristics desired, as is well known in the art. In the particular embodiments described herein, the thickness may range from about 0.150 to about 0.180 inches with about 0.150" being preferred for a 44" backboard design and 0.177" being preferred for a 48" backboard design. However, different thicknesses may be used, as will be readily apparent to the skilled artisan, depending upon cost, particular rebounding performance, and durability characteristics described.

The rebound member has an outer peripheral edge portion 9 captured and supported by the plastic channel member, as described in detail below. Goal mounting holes 40 and 41 are formed in the substrate and are located toward the lower portion of the rebound member for receiving conventional basketball goal mounting bolts or similar fastening structure. Mounting holes 40 align with holes 34 in horizontal member 29 of U-shaped inner frame section 26. Similarly, mounting holes 41 align with holes 38 of support plate 22. In this manner, only four goal mounting fasteners extend through the acrylic rebound member. Holes 40 and 41 may be larger in diameter than holes 34 and 38 in order to assist in aligning the holes in the rebound member and frame sections during assembly, as well as providing for manufacturing tolerances. In addition, the hole pattern may be shifted depending upon the desired location of the goal by moving holes 34 from the horizontal member 29 of U-shaped inner frame section 26 to the horizontal portion 21 of outer frame section 20, or providing an additional set of holes therein, which would permit the goal to be mounted in an upper or lower position.

Figure 7:
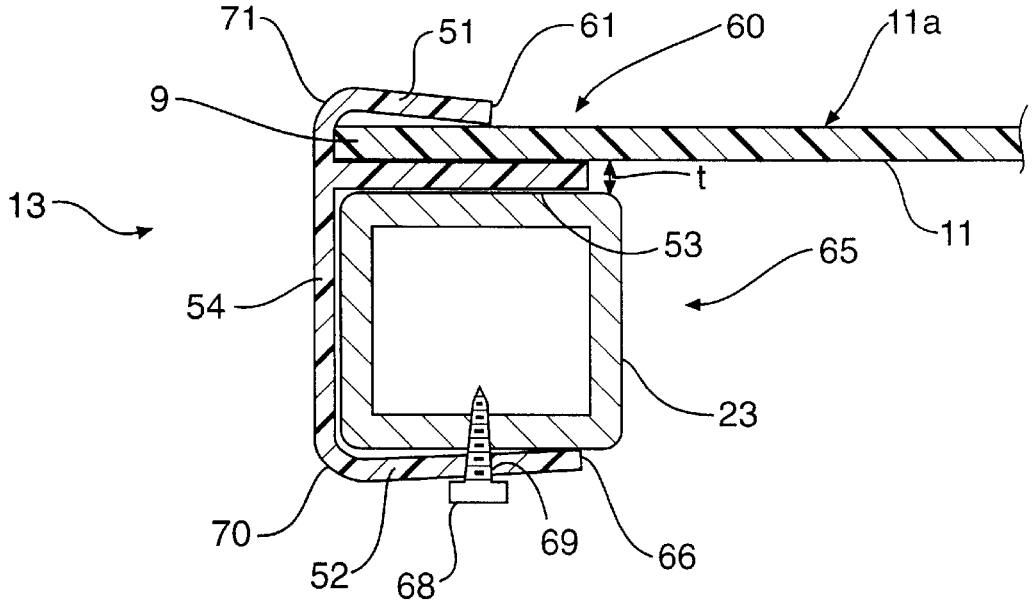
FIG. 7 is a cross sectional view of the plastic channel member of the invention illustrating how the rebound member is connected to the frame by the channel member.

FIG. 7 shows an enlarged cross sectional view of the plastic channel member of the invention, which more clearly illustrates how the plastic channel member supports the rebound member 11 on a typical portion of frame 12. The plastic channel member is preferably formed as a single piece of rigid extruded plastic made from exterior grade polyvinyl-chloride (PVC), which is compounded with stabilizers for protection against ultra-violet radiation as is well known in the art. The extruded plastic member may also be made with high impact resins to add strength to its structure, however this would have a corresponding increase in manufacturing costs.

The plastic is extruded into a channel preferably having a generally "E" shaped cross section defined by first and second spaced, outer flanges 51 and 52, which extend outwardly from web portion 54 interconnecting the two outer flanges. An inner flange 53 also extends outwardly from web portion 54 at a position intermediate the outer flanges, but closer to first flange 51. Slot 60 configured to receive the peripheral edge 9 of rebound member 11 is defined by outer flange 51, inner flange 53 and the portion of web 54 extending therebetween. The slot 60 has a width approximately equal to the thickness of rebound member 11 such that an interference fit is created between the rebound member 11 and the plastic channel 13 when the peripheral edge portion 9 of the rebound member is received in slot 60. The interference fit may be enhanced by angling the outer flange 51 toward inner flange 53 by angle $\theta_1$, which is preferably approximately 15°. As the peripheral edge portion 9 of rebound member 11 is positioned within slot 60, the end portion 61 of outer flange 51 is deflected outwardly and therefore abuts the front face 11*a* of rebound member 11 with increased force. The rebound member 11 is retained in slot 60 without the need for additional fastening structures such as holes in the rebound member, which can promote cracking. In this manner, the peripheral edge portion 9 of the rebound member is encapsulated by the plastic channel 13.

Slot 65 configured to receive a portion of frame 12 is defined by outer flange 52, inner flange 53 and the remaining, majority portion of web 54 extending between the flanges 52, 53. The width of slot 65, i.e. distance between the flanges is approximately equal to the thickness of the frame such that an interference fit is created between the plastic channel and the frame where the frame portion, e.g., vertical frame portion 23 is received in slot 65. Outer flange 52 may angle toward inner wall 53 by angle $\theta_2$, which is preferably approximately 13°. As the frame portion 23 is positioned in slot 65, the end portion 66 of angled outer web 52 is deflected outwardly and therefore abuts against the frame member with increased force, thereby enhancing the interference fit between the extruded plastic member and the frame member. The interference fit between the plastic channel and frame may be supplemented or replaced with a detachable connection, e.g. by use of a separate fastening structure, such as a self-tapping screw 68, shown in phantom, which may be positioned in an alignment groove 69 formed in the channel 13. Other fastening structures such as molded snaps and push-in fasteners may also be used. The screw 68 extends through outer web 52 and into frame member 23. The alignment groove may extend the length of the plastic channel such that the fastening structure may be positioned anywhere along the alignment groove as desired. The outer corners of the extruded plastic channel are formed with rounded edges 70 and 71 to minimize user injury during handling.

Figure 7A:
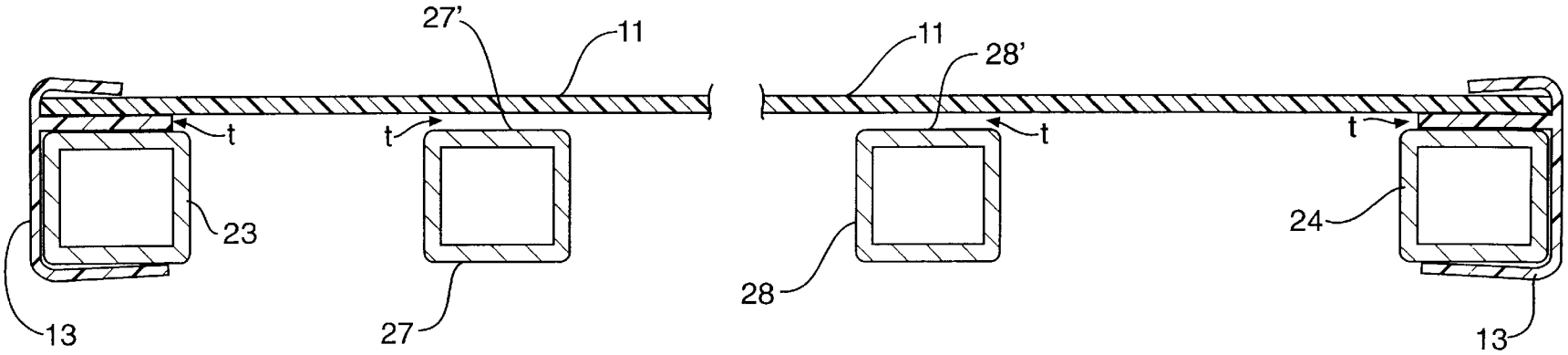
FIG. 7A is a simplified cross-sectional view of the rebound member, plastic channel and a portion of the inner frame section illustrating the controlled flexure of the rebound member.

The plastic channel 13 supports rebound member 11 on frame 12 at a designed clearance space "t," which preferably is approximately equal to the thickness of inner flange 53 that separates the rebound member from the frame. The relationship between clearance space "t" and the frame is illustrated in FIG. 7A, which is a simplified cross-sectional view of the rebound member 11, plastic channel 13, vertical frame members 23 and 24 and vertical beam portions 27 and 28, but is obviously not drawn to scale. The peripheral edge 9 of rebound member 11 is secured to the plastic channel 13 by the interference fit in slot 60. This interference fit limits the rebound member from flexing within slot 60 to the very small amount permitted by the flange 51, which is inherently inflexible due to use of rigid plastic material like exterior grade PVC to make the channel 13. However, the rebound member is not secured to the inner frame section 26, particularly vertical beam portions 27 and 28, which allows the rebound member some inward flexure toward the inner frame section. The amount of inward flexure of the rebound member is limited and controlled by the inner frame 26 to be approximately equal to the amount of clearance space "t." Similarly, the rebound member may also flex outward away from the inner frame section and is limited solely by the amount of flexibility inherent in the rebound member and the rigidity of the interference fit between the rebound member 11 and channel 13. Thus, clearance space "t" allows the rebound member 11 to flex across its entire unsupported surface area when struck by a basketball, thereby providing greater impact resistance as compared to prior art backboards that bond acrylic sheets directly to the frame structure using double sided tapes or adhesives. Clearance space "t" may also be eliminated or reduced as desired by attaching a padding material, such as foamed inserts, to the surfaces 27' and 28' of vertical beams 27 and 28, thereby decreasing lateral movement of the rebound member toward the frame while still permitting flexing of the rebound member across its entire unsupported surface area.

Figure 6A:
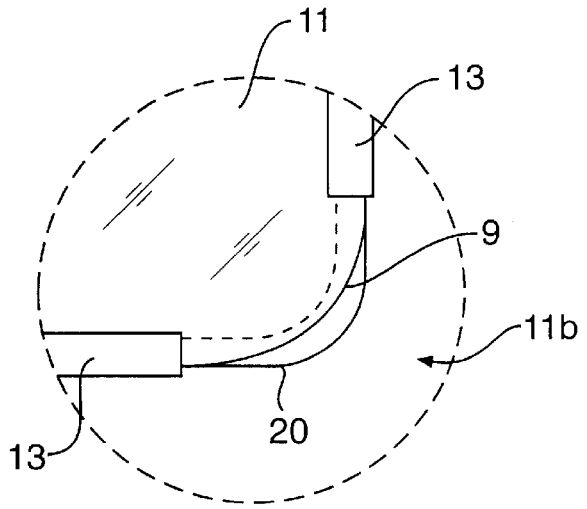
FIG. 6A is an exploded view of a corner portion 11*d* of the backboard assembly shown in FIG. 3.

FIG. 6A shows an enlarged view of corner 11*b* of the backboard assembly of FIG. 3, which more clearly illustrates how corners 11*a*, 11*b*, 11*c* and 11*d* of the backboard may be configured to reduce the possibility of damaging the peripheral edge of the rebound member during handling. The radius of curvature at corner 11*b* of rebound member 11 is greater than the radius of curvature of outer frame section 20. This larger radius provides a shallower rounded turn of the exposed portion of peripheral edge 9 of rebound member 11 between plastic channel members 13 such that the peripheral edge falls within the radius of curvature of the outer frame section 20 at the corner locations. In this manner, if a corner of the backboard assembly comes into contact with a hard surface, such as the ground during installation or otherwise, the portion of the corner that actually touches the hard surface is limited to the outer frame section 20 thereby protecting the peripheral edge of the rebound member.

The backboard illustrated in FIG. 3–7 may be assembled advantageously as follows. After the frame 12 is formed by welding the outer frame section 20, inner frame section 26 and support plate 35 together as described above, the rebound member 11 is positioned on top of the front surface of the frame. Four plastic channels 13 are positioned around the perimeter of the backboard assembly as shown with reference to FIG. 3. The rebound member is then lifted away slightly from the frame to position the peripheral edge portion 9 of rebound member 11 into slot 60 in one of the four plastic channels 13. In addition, the channel is mounted upon one of the horizontal frame portions 21 and 22 and vertical frame portions 23 and 24 such that it is received into slot 65 of plastic channel 13. This is repeated until all four of the channels are connected to the frame portions and the peripheral edge portion received in slot 60 of each channel. In this manner, the front face 11*a* of rebound member 11 is substantially unobstructed by the plastic channels and frame sections to provide access to the rebound surface 11*a*. Each of the four plastic channels 13 may be further connected to each of their corresponding frame members by way of self-tapping screws or similar fasteners positioned in the alignment grounds. Substantially all of the peripheral edge 9 portions of rebound member 11 (except for the corner areas) are encapsulated within the channel members, thereby reducing the likelihood that cracks will form in the rebound member. The plastic channels also serve to reduce the weight of the backboard assembly when compared to conventional backboards, thereby facilitating use with portable support systems. Suitable equipment could be provided to automate the assembly steps described above.

Figure 8A:
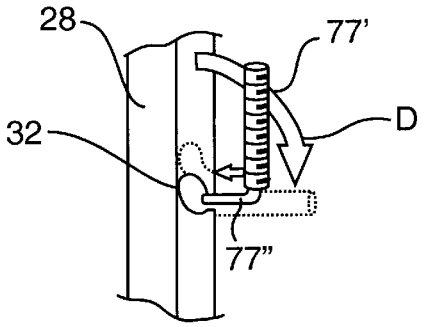
FIG. 8A is an exploded view of the insertion of an angled bolt into a vertical beam of the backboard assembly shown in FIG. 8.

FIGS. 8–10 schematically illustrate three different types of conventional mounting structures for supporting the backboard assembly of the invention. FIG. 8 illustrates how the backboard assembly may be connected to a pole, roof, or wall mounting structure 85. Frame 12 is substantially similar to the frame illustrated and described with reference to FIG. 4, however, it shows an alternative aperture arrangement in which support plate 35 includes four goal mounting apertures 71 instead of providing two on the inner frame section and two on the support plate. Mounting plate 70 may be disposed between the mounting portion of goal 14 and the support plate 35 to facilitate attaching the basketball goal 14 to the frame 12. Goal 14 is attached to the backboard assembly by way of mounting bolts 78, washers 79*a* and 79*b* nuts 80. The bolts 78 extend through the apertures in the goal, mounting plate 70 and support plate 35, which are aligned. The bolts 78 are connected to nuts 80 in a conventional manner. Mounting bracket 85, which may be connected to a vertical pole, garage roof or other support structure, attaches to U-shaped beam 26 by way of fasteners 77, washers 81 and nuts 82. As shown in FIG. 8A, fastener 77 may be an L-shaped angled bolt having a threaded portion 77'. Aperture 32 does not extend completely through the cross section of vertical beams 27 and 28, and are configured to receive the unthreaded portion of the angled bolt. As the unthreaded portion is inserted into aperture 32, the fastener is then rotated in a downward direction, as referenced by arrow D, which forces the unthreaded portion upward into vertical beam 28. An angled alignment insert (not shown) may also be positioned in aperture 32 to restrict the lateral movement of the fastener while a nut is connected thereto. In this manner, fasteners 77 are prevented from coming into contact with the rebound member.

Figure 9A:
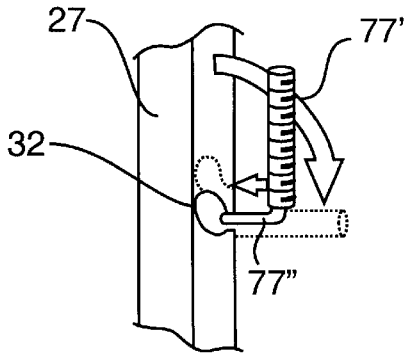
FIG. 9A is an exploded view of the insertion of an angled bolt into a vertical beam of the backboard assembly shown in FIG. 9.

FIG. 9 illustrates how a support arm and extension arms may be connected to the backboard assembly of the invention. Backboard assembly 10 is attached to one end of a support arm 75, having another end connected to a support pole. The same apertures, bolts, and associated hardware used for attaching goal 14 to the backboard are used to attach the extension arm, backboard and goal together. Extension arms 76 (only one shown in FIG. 8) attach at one end to bolts 77 in U-shaped inner frame structure 26 and at its other end (not shown) to the support pole to assist in supporting the backboard assembly. FIG. 9A shows apertures 32 located in the upper portion of vertical beam 27 receiving angled bolt 77 in the same manner as described in FIG. 8A. The extension arms 76 are attached to the vertical beams by way of bolts 77 in a conventional manner.

FIG. 10 illustrates how the backboard assembly is connected to an elevator mounting structure which facilitates height adjustment in a manner known in the art. The elevator mounting structure includes a beam 90 having a pair of diagonally extending arms 91 and 92 having apertures 93 for receiving angled bolt fasteners 77 which extend from U-shaped inner frame section 26 in the same mount as the previous mounting embodiment. Goal 14 is connected to the elevator beam 90, by way of mounting bolts 78, which extend through apertures 94, washers 79*a* and nuts 80.

The above described mounting structures are illustrative of the various ways the backboard assembly of the invention may be supported. Other support systems may be used as well.

Figure 11:
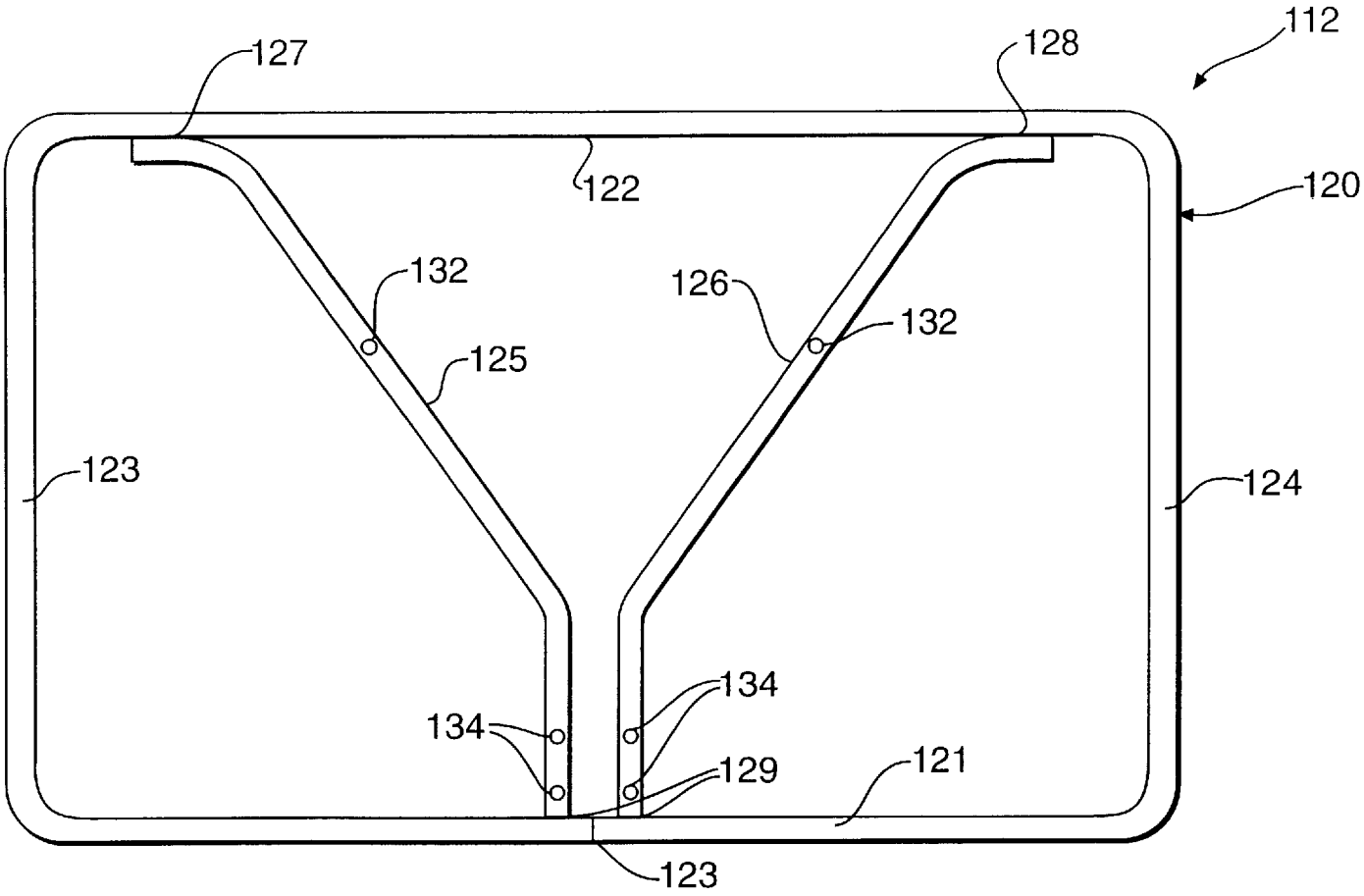
FIG. 11 is a rear plan view illustrating an alternative embodiment of the frame of the invention.

FIG. 11 shows an alternative embodiment of the invention utilizing a different frame configuration 112. This alternative embodiment is particularly suited for a backboard having a width size of approximately 48", although other sizes obviously may be employed. Frame 112 has an inner frame section that differs from the previously described inner frame section, which is formed from U-shaped frame 26 and support plate 35.

The inner section of frame 112 is formed from a pair of bent, diagonal beams 125 and 126, which preferably are also made from tubular steel of the same stock as outer frame section 120. The beams are disposed between and attached, preferably by welding to horizontal frame portions 121 and 122 of frame 120 at 127, 128, and 129, to form a generally "Y" -shaped inner support section for increasing the strength and rigidity of the frame. Apertures 132 in diagonal beams 125 and 126, receive angled fasteners for attaching the backboard assembly to a support structure, such as those described above with reference to FIGS. 8–10 without having the fasteners extend through the diagonal beams and contact the rebound member 11. The diagonal beams also have a relatively short straight section, which include apertures 134 for mounting a basketball goal to the frame 120 in a conventional manner.

The above described embodiments illustrate a backboard assembly having a substantially rectangular shape with rounded corners, in which four plastic channel members are attached to the perimeter of the substantially rectangular backboard assembly. More specifically, as shown best in FIG. 3, the plastic channels are attached to the straight vertical and horizontal sections of the frame, thereby encapsulating the straight sections of the peripheral edge portion of the rebound member while leaving the rebound member exposed solely at the corners.

Figure 12B:
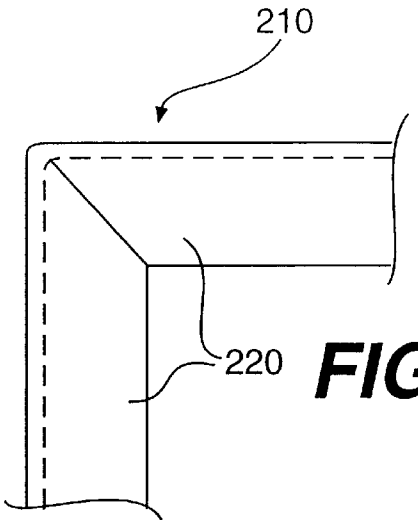
FIGS. 12*a–f* illustrate various embodiments in which the peripheral edge of the rebound member may be completely encapsulated by the plastic channel member of the invention. More specifically.
Figure 12D:
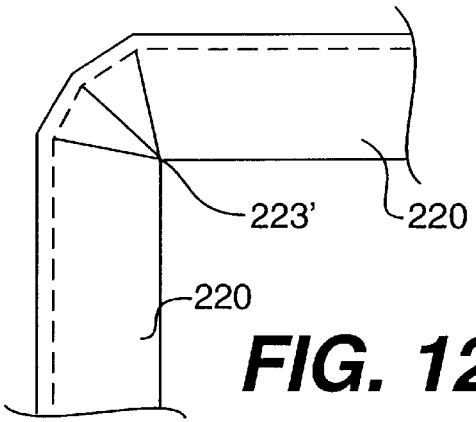
Figure 12A:
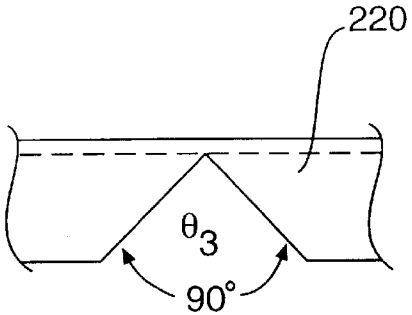
Figure 12C:
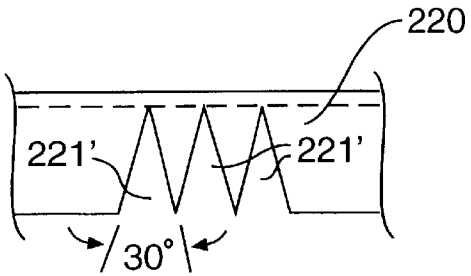
Figure 12F:
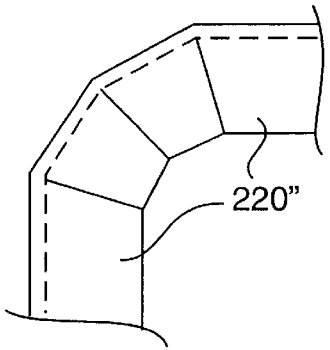
Figure 12E:
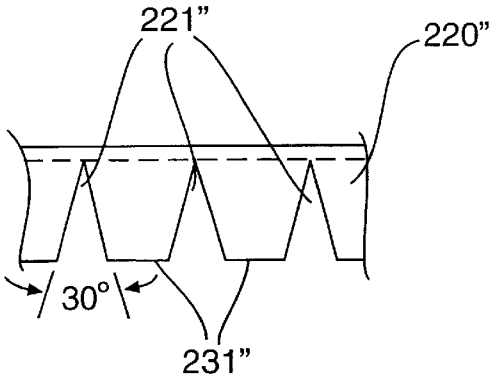

Alternatively, a single channel may be provided that extends around the entire perimeter of the backboard assembly, including the rounded corners, thereby completely encapsulating the peripheral edge portion of the rebound member. In this embodiment, a single channel member having a length equal to the perimeter of the frame may be provided again, preferably by extruding rigid plastic material into a channel member as discussed above. The rigid plastic, however, must be shaped to fit the radius of curvature of the four corners of the backboard assembly. Two examples of how this may be accomplished are described below, however, any suitable method for wrapping the channel around and attaching it to the perimeter of the frame may be employed. The first method described with reference to FIGS. 12*a–f* involves providing notches in the flanges of the channel to facilitate bending of the channel to conform to the corners of the frame and rebound member. The number of notches corresponds to the size of the backboard and the desired curvature of the corner. For example, FIG. 12*a*, 12*b* illustrate a straight extruded plastic channel 210 having a cross section similar to that illustrated in FIG. 7 wherein a notch is formed through the flanges that define the slots receiving the frame and rebound member, although for simplicity only one of such notched flanges 220 is illustrated in FIGS. 12*a–f*. FIGS. 12*a*–12*b* show an embodiment in which a notch 221 forms an approximately 90° angle referenced at $\Theta_3$. The plastic channel member is then bent at the notched portion thereby creating the squared corner of FIG. 12*b*. As a second example, FIG. 12*c* illustrates a straight plastic channel member 220 wherein three separate notches 221' are formed at approximately 30° angles. The plastic channel is then bent about central point 223' thereby creating a somewhat rounded corner shown FIG. 12*d*. A third example is illustrated in FIG. 12*e* wherein three separate notches 221", equally spaced apart by a distance 231" are formed in the straight channel member 220" at approximately 30° angles. The channel member 220" is bent about the notched portions thereby creating the "octagonal-like" corner of FIG. 12*f*. As can be understood from the above description, the desired corner configuration may be achieved by increasing or decreasing the number of notches, altering the spacing between the notches, and changing the size of the angle of each notch formed in the extruded plastic member. Specifically, more notches in smaller degree movements produce a smoother bend in the corner, and as the notches are spaced apart, the inside radius grows.

An alternative method for forming the desired corner configurations of the plastic channel uses hot oil to facilitate bending the channel into corners. The plastic channel member may be dipped in hot oil at a temperature sufficient to temporarily decrease its rigidity. The plastic channel is then bent into the desired shape around the frame corners and connected to the frame as described above.

Figure 13:
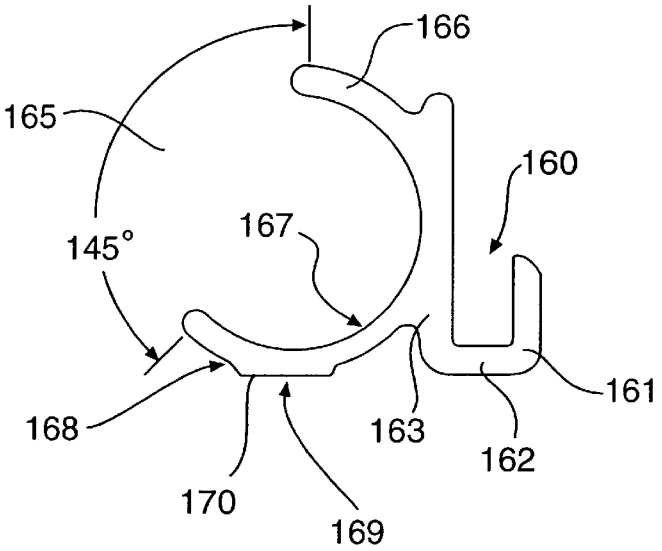
FIG. 13 is a cross sectional view of an alternative embodiment of the plastic channel member of the invention configured to receive a rounded frame section.

FIG. 13 shows a alternative design for the plastic channel member of the invention, which is configured to receive rounded instead of square cross-sectional frame members previously described. Similar to the plastic channel member of FIG. 7, in this embodiment the plastic channel is preferably made from exterior grade polyvinyl-chloride (PVC), which is extruded into the cross sectional shape shown in FIG. 13, and compounded with stabilizers for protection against ultra-violet radiation. Slot 160 defined by outer flange 161, base 162 and inner flange 163 is configured to receive the peripheral edge 9 portion of rebound member 11. The width of slot 60 is approximately equal to the thickness of rebound member 11 such that an interference fit is created between the rebound member and the extruded plastic member when the pieces are joined. Although not shown in FIG. 13, one or more of the flanges may be angled inwardly to increase the force created by the interference fit.

Slot 165 having a reverse "C" shaped cross section is defined by an arcuate wall 166 integrally extruded with inner flange 163. Slot 165 receives a portion of a frame having a rounded cross sectional shape that generally matches the cross section of circular slot 165. Slot 165 has an opening preferably extending about 145° to facilitate insertion of the rounded frame into the slot. The radius of slot 165 is approximately equal to or greater than the radius of the frame portion such that an interference fit is created between the plastic channel and the rounded frame portion as it is positioned in slot 165 and abuts the inner surface 167 of arcuate wall 166. The outer surface 168 of arcuate wall 166 includes a flat portion 170 on which an alignment groove 169 is formed. Similar to the FIG. 7 embodiment, to supplement or replace the interference fit the plastic channel may be detachably connected to the frame portion by way of a fastening structure, such as a self-tapping screw, positioned in alignment groove 169. The fastening structure extends through arcuate wall 166 and into the frame portion to secure the two pieces together. Similar to the FIG. 7 embodiment, the rebound member and frame portions are retained within slots 160 and 165 respectively, at a small clearance, which is preferably approximately equal to the thickness of inner flange 163.

Figure 14:
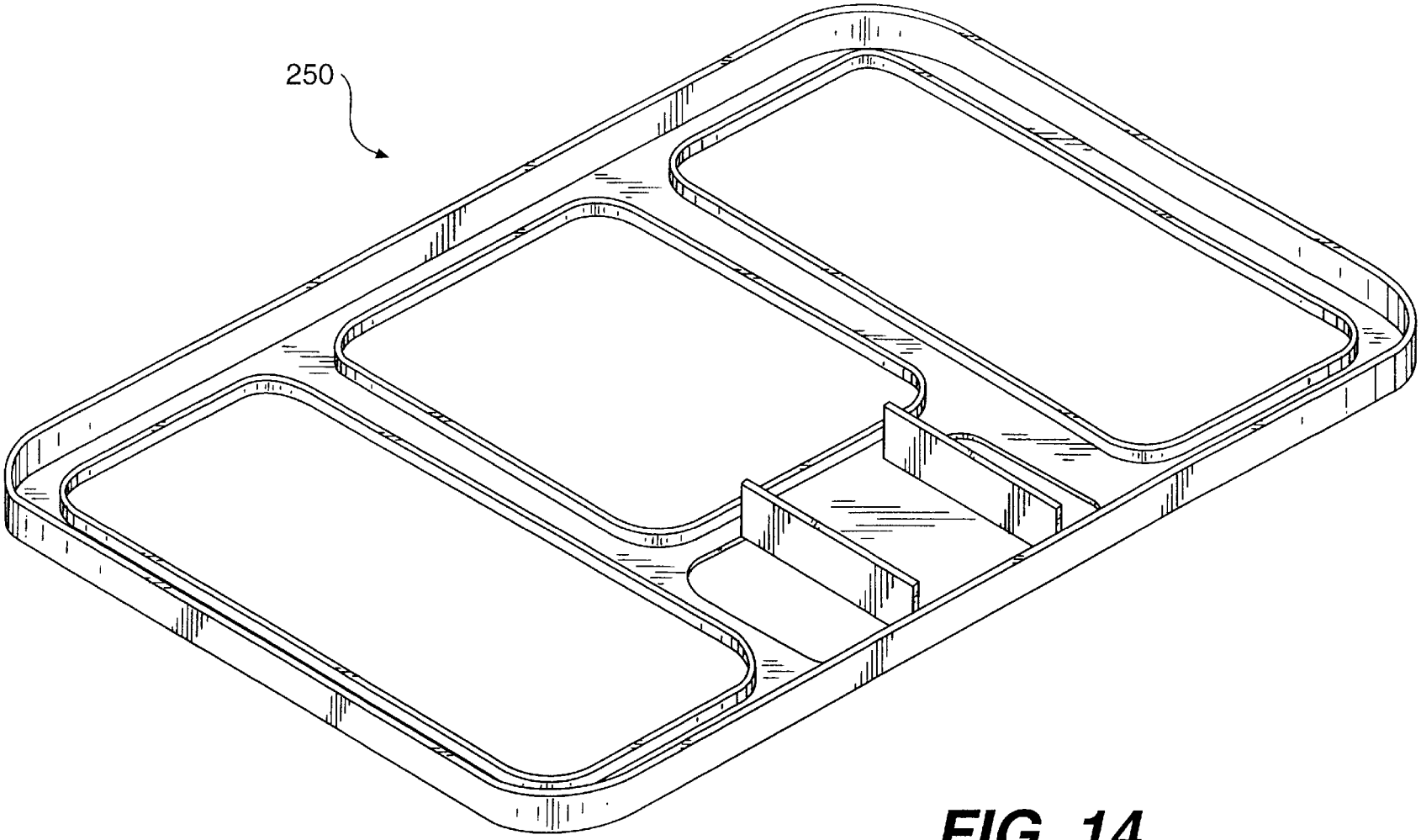
FIG. 14 is a rear perspective view of another alternative embodiment of a frame of the invention.

Referring to FIG. 14, another alternative embodiment of the frame of the invention is shown and designated by reference numeral 250. This frame is substantially similar to the previous frame embodiments, however, it is formed from stamped steel or other materials of suitable strength and rigidity, such as thermoplastics or engineered plastic sheets, as opposed to welding several pieces of tubular steel members together. The advantages of the stamped steel frame are increased strength for supporting the rebound member, however the stamped steel method requires substantial investments in manufacturing equipment and tooling to perform the necessary processing steps. Although this alternative embodiment increases the strength and rigidity of the backboard assembly, it also adds cost and weight which may not be desirable in certain applications like these for portable support systems.

What is claimed is:

1. A basketball backboard comprising:

a rebound member having a rebound surface and a peripheral edge surrounding said rebound surface; and a support member including a plastic retainer and a frame, said retainer having a cross section defining a first slot configured to receive a portion of said frame and a second slot configured to receive at least a portion of said peripheral edge of said rebound member.

2. The basketball backboard of claim 1 wherein said retainer is connected to said frame portion by an interference fit.

3. The basketball backboard of claim 1 wherein said retainer is detachably connected to said frame by at least one fastening structure.

4. The basketball backboard of claim 2 wherein said retainer is detachably connected to said frame by at least one fastening structure.

5. The basketball backboard of claim 3 wherein said fastening structure includes at least one element selected from the group consisting essentially of self-tapping screws, molded snaps, and push-in fasteners.

6. The basketball backboard of claim 1 wherein said cross section of said retainer is defined by first, second and third wall members and a base, with said first, second and third wall members extending outwardly from said base, said third wall member disposed between said first and second wall members, with said first slot being defined between said first and third wall members, and said second slot being defined between said second and third outer wall members.

7. The basketball backboard of claim 6 wherein said wall members and base define a generally E-shaped cross sectional shape.

8. The basketball backboard of claim 6 wherein at least one of said first and third outer wall members is angled toward each other.

9. The basketball backboard of claim 6 wherein at least one of said second and third wall members is angled toward each other.

10. The basketball backboard of claim 1 wherein said rebound member has front and rear faces, said rebound surface being defined on said front face.

11. The basketball backboard of claim 10 wherein said retainer is connected to said frame such that a clearance space is disposed between said rear face and said frame, said clearance space permitting limited flexing of said rebound member.

12. The basketball backboard of claim 11 wherein said clearance space is approximately equal to the thickness of said third wall member.

13. The basketball backboard of claim 11 further comprising padding material disposed in said clearance space to reduce the space between said rear face and said frame.

14. The basketball backboard of claim 1 wherein said retainer comprises a plurality of individual plastic pieces disposed around said periphery of said rebound member, each of said pieces coupling said rebound member to said frame by an interference fit in said second slot.

15. The basketball backboard of claim 14 wherein said retainer encapsulates substantially all of the peripheral edge of said rebound member.

16. The basketball backboard of claim 1 wherein said retainer comprises a single piece of plastic encapsulating the entire peripheral edge of said rebound member.

17. The basketball backboard of claim 16 wherein said retainer includes cut-out portions facilitating bending of said plastic piece.

18. The basketball backboard of claim 1 wherein said rebound surface is formed on a front surface of said rebound member, said retainer coupling said frame and said rebound member such that said front surface is substantially unobstructed by said retainer.

19. The basketball backboard of claim 1 wherein said rebound member comprises a substantially planar sheet of material formed from at least one material selected from the group consisting essentially of molded plastic, wood, laminate, tempered glass and metal, said retainer is formed from an extruded plastic material, and said frame is formed from steel having a tubular cross-section.

20. The basketball backboard of claim 1 wherein said frame is stamped from at least one material selected from the group consisting essentially of metal, thermoplastics, and engineered plastic sheets.

21. The basketball backboard of claim 1 wherein said frame includes an aperture formed in a rear surface of said frame, said aperture being configured to receive a fastener for mounting the backboard on a support system, said aperture being of predetermined length which is less than the thickness of the frame such that said fastener is isolated from said rebound member.

22. The basketball backboard of claim 1 wherein said frame comprises outer and inner support structures, with at least one of said support structures including a goal mounting portion for attaching a basketball goal thereto.

23. The basketball backboard of claim 22 wherein said outer support structure has a generally rectangular outer perimeter and said inner support structure comprises a bracing system connected to said outer support structure.

24. The basketball backboard of claim 23 wherein said bracing system comprises a generally "U" shaped beam and a plate connecting said outer support structure to said generally "U" shaped beam.

25. The basketball backboard of claim 23 wherein said bracing system comprises a pair of beams connected to opposed portions of said outer support structure.

26. The basketball backboard of claim 1 wherein said frame includes a rounded portion and said cross-section of said retainer is defined by first, second and third wall members and a base, with said first and second wall members extending outwardly from said base to define said first slot, said third wall member being integrally attached to said second wall member and having an arcuate-shaped opening configured to receive said rounded portion of said frame.

27. The basketball backboard of claim 26 wherein said retainer is connected to said frame by an interference fit and said rebound member is connected to said retainer by an interference fit.

28. The basketball backboard of claim 27 further comprising at least one fastening structure detachably connecting said retainer and said frame.

29. A basketball backboard assembly comprising:

a rebound member;

a frame for supporting the rebound member on a mounting structure; and at least one plastic retainer coupling the rebound member to said frame.

30. The basketball backboard assembly of claim 29 wherein said rebound member has a peripheral edge, and said at least one retainer encapsulates substantially all of said peripheral edge.

31. The basketball backboard assembly of claim 29 wherein said rebound member has a peripheral edge and said at least one retainer encapsulates all of said peripheral edge.

32. A method of making a basketball backboard assembly from a rebound member, frame and plastic retainer, said method comprising the steps of:

(a) providing a rebound member having a rebound surface and a peripheral edge surrounding said rebound surface;

(b) providing a frame for supporting the rebound member;

(c) providing a plastic retainer having first and second slots;

(d) inserting at least a portion of said frame in the first slot; and (e) inserting at least a portion of the peripheral edge of the rebound member within the second slot of said retainer.

33. The method of claim 32 further comprising the step of coupling the rebound member to the frame with the retainer to create a clearance space between the rebound member and the frame permitting limited flexing of the rebound member.

34. The method of claim 32 wherein the step of inserting the frame portion into the first slot creates a first interference fit that attaches the retainer to the frame such that the rebound surface is substantially unobstructed by said retainer.

35. The method of claim 34 further comprising the step of detachably connecting the frame and retainer together with at least one fastener.

36. The method of claim 32 further comprising the step of detachably connecting the frame and retainer together with at least one fastener.

37. The method of claim 32 wherein the step of inserting at least a portion of the peripheral edge in the second slot provides an interference bit between the rebound member and the retainer.

38. The method of claim 32 wherein the step of providing a plastic retainer comprises providing a plurality of plastic retainers disposed around the periphery of the frame, and the step of inserting at least a portion of the peripheral edge of the rebound member within the second slot of the retainers encapsulates substantially all of the peripheral edge within the retainers.

39. The method of claim 32 wherein the step of inserting at least a portion of the peripheral edge of the rebound member within the second slot of the retainer comprises inserting all of the peripheral edge to completely encapsulate it within the retainer.

40. The method of claim 39 wherein said frame includes a curved portion defined by a first radius of curvature, and said step of inserting all of the peripheral edge in the second slot comprises bending the plastic retainer such that said retainer has a second radius of curvature that conforms to the first radius of curvature.

41. The method of claim 40 further comprising the step of subjecting the plastic retainer to hot oil to facilitate bending of the plastic retainer around the curved portion of the rebound member.

42. The method of claim 40 further comprising the step of creating at least one notch in the plastic retainer to facilitate bending of the plastic retainer.

43. The method of claim 32 wherein the step of providing a plastic retainer comprises extruding an exterior grade plastic including polyvinylchloride into a channel-shaped member.

* * * * *